United States Patent [19]

Nicolas et al.

[11] Patent Number: 4,686,844

[45] Date of Patent: Aug. 18, 1987

[54] METHOD OF BENDING A THICK METAL TUBE, AND APPARATUS FOR IMPLEMENTING THE METHOD

[75] Inventors: Jacques Nicolas, Bondues; Gilbert Degrande, Hem, both of France

[73] Assignee: Stein Industrie, Velizy Villacoublay, France

[21] Appl. No.: 847,384

[22] Filed: Apr. 2, 1986

[30] Foreign Application Priority Data

Apr. 4, 1985 [FR] France ..... 85 05171

[51] Int. Cl.[4] ..... B21D 7/12; B21D 7/16

[52] U.S. Cl. ..... 72/13; 72/128; 72/369

[58] Field of Search ..... 72/13, 128, 342, 364, 72/369

[56] References Cited

U.S. PATENT DOCUMENTS

| | | | |
|---|---|---|---|
| 1,996,838 | 4/1935 | Snell | 72/369 |
| 3,896,649 | 7/1975 | Stuart | 72/128 |
| 4,151,732 | 5/1979 | Hofstede et al. | 72/128 X |
| 4,177,661 | 12/1979 | Schwarzbach et al. | 72/128 |
| 4,414,833 | 11/1983 | Nicolas et al. | 72/13 |

*Primary Examiner*—E. Michael Combs

*Attorney, Agent, or Firm*—Sughrue, Mion, Zinn, Macpeak & Seas

[57] ABSTRACT

A method and apparatus for bending thick metal tubes is disclosed and is characterized in that thermal insulation is disposed inside the heated zone of the tube being bent, and that the thickness of said thermal insulation is great enough to considerably reduce the temperature gradient between the inside and outside surfaces of the tube in said heated zone.

2 Claims, 2 Drawing Figures

METHOD OF BENDING A THICK METAL TUBE, AND APPARATUS FOR IMPLEMENTING THE METHOD

FIELD OF THE INVENTION

The present invention relates to a method of bending a thick metal tube of constant right cross-section, by localized heating of a narrow zone of the periphery of said tube by means of a heating collar surrounding said zone, by thrusting against one end of the tube, and by holding its other end by means of a pivoting arm, wherein the temperature of the heated zone around the periphery of the tube is maintained substantially constant by detecting, at at least two points round said periphery, either the temperature of said heated zone or else the gap between the heating collar and the periphery of said zone, a first one of said points being on the center of curvature side and the other point being opposite to the first point, and by increasing or reducing the application of heat at one or other of these points depending on whether the temperature thereat is below or above, or on whether the gap thereat is above or below a reference value corresponding to a uniform temperature or to a uniform gap around the heated zone. The invention also applies to apparatus for performing the method.

BACKGROUND OF THE INVENTION

A method and apparatus of this type has already been proposed in U.S. Pat. No. 4,414,833, which method is applicable more generally to any elongate metal element of constant cross section.

However, it has been observed that when implementing such a method on thick tubes, a large temperature gradient appears between the outside surface of the heated zone and its inside surface. In the usual case where the heating collar is an inductor element generating eddy currents in the tube, only the first 15 to 20 mm of the tube thickness from its outside surface are heated by the eddy currents, with the rest of the thickness being heated only by conduction, and therefore remaining at a lower temperature. This large temperature gradient gives rise to a relatively high average plastic stress coefficient. If it is desired to avoid the appearance of faults on the inside surface of the tube, this means that the tube to be bent must be advanced rather slowly, and consequently that the hourly bent tube production rate is less than that which could be achieved using tubes which are sufficiently thin for the temperature of the heated zone to remain substantially constant throughout the entire tube thickness. This difficulty is particularly severe, for example, when using steel tubes which are lightly alloyed with 2 to 2.5% by weight chromium and 0.9 to 1.2% by weight molybdenum using the alloy known as 10 CD 9.10 (DIN designation 10CrMo9.10).

Preferred implementations of the present invention provide a method and an apparatus for bending a thick metal tube while reducing the temperature gradient between the inside and outside surfaces of the heated zone to a relatively small value, thereby ensuring that good metallurgical behavior of the tube to be bent is obtained, and consequently reducing the average plasticity stress coefficient in said zone, thereby enabling the hourly bent tube production rate to be increased.

Further, the detection of the temperature of the heated zone and/or the size of the gap between the heating collar and the periphery of the pipe zone, and the subsequent modification of the heat applied to said zone responsive to the noted detections are effected with respect to bending the thick alloy tubes of this invention in the same manner as described in the disclosure of our prior U.S. Pat. No. 4,414,833 which is incorporated by reference herein.

SUMMARY OF THE INVENTION

The method in accordance with the invention includes the improvement of thermal insulation is disposed inside the heated zone over a sufficient thickness to considerably reduce the temperature gradient between inside and outside surfaces of the tube in the heated zone.

Apparatus in accordance with the invention includes a cylindrical carriage having wheels for internal guidance inside the tube, with a metal support ring being fixed to the carriage downstream from the direction of tube advance, said ring being covered with a thermally insulating layer having an outside diameter close to the inside diameter of the tube and being held by a fixed rod in a position such that the thermally insulating layer is located level with the heated zone.

BRIEF DESCRIPTION OF THE DRAWINGS

By way of example there follows a description of apparatus for bending a thick metal tube in accordance with the invention and with reference to the figures of the accompanying drawings.

MORE DETAILED DESCRIPTION

Figure 1:
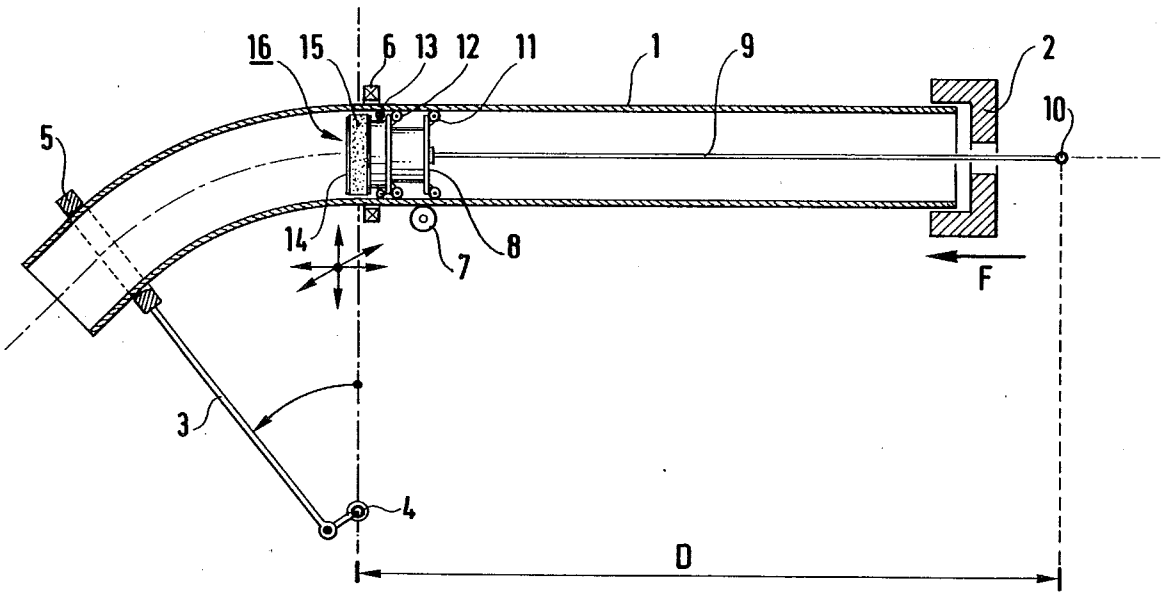
FIG. 1 is an overall view of the bending apparatus.
Figure 2:
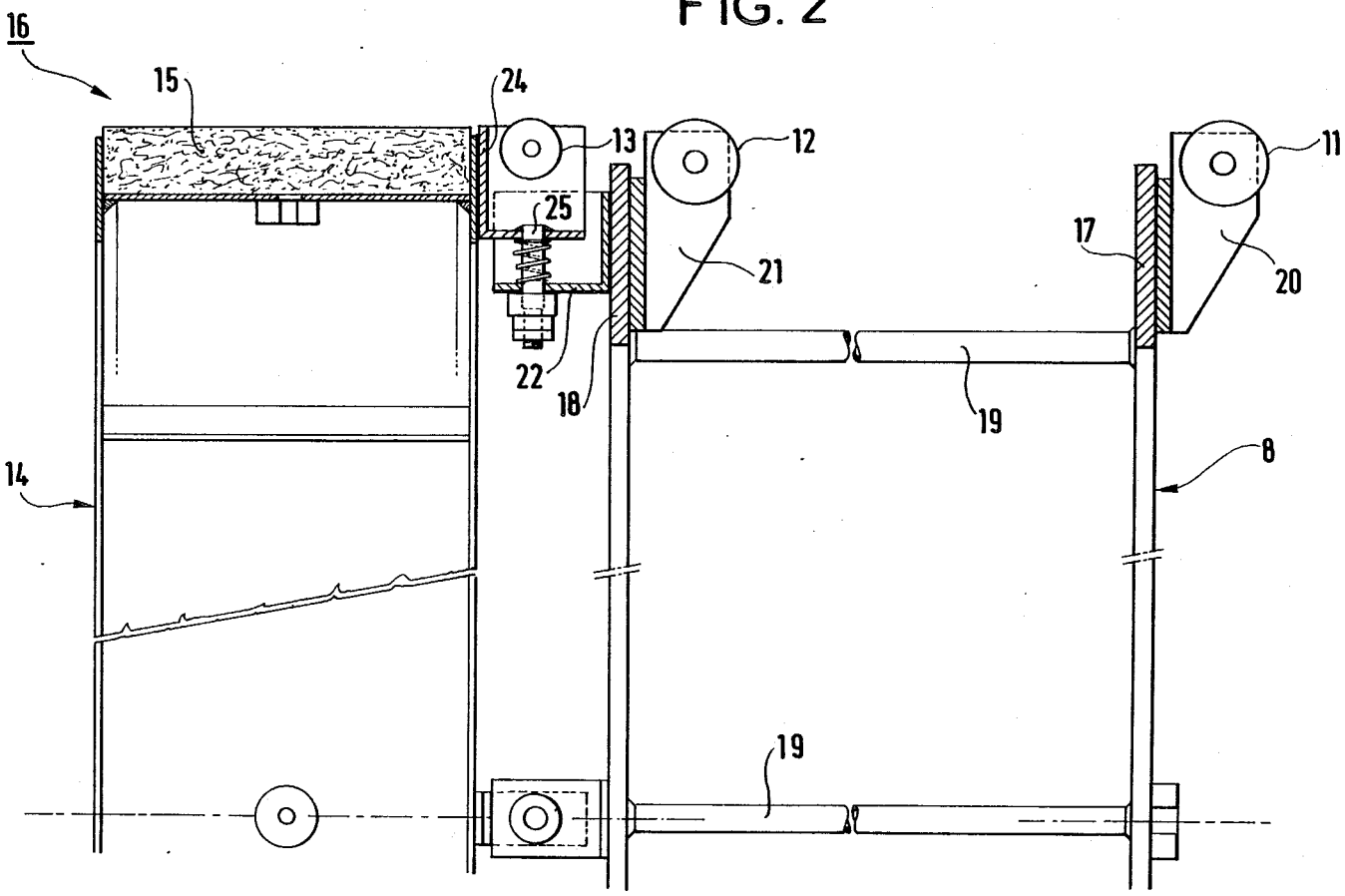
FIG. 2 shows a detail 16 of FIG. 1 to a larger scale.

The invention is more particularly applicable to lightly alloyed steel tubes having 2 to 2.5% by weight chromium and 0.9 to 1.2% by weight molybdenum, and in particular to alloys known as 10 CD 9.10 (DIN standard 10CrMo9 10), for which the metallurgical behavior and the plasticity stress coefficient vary considerably with temperature.

The thick tube 1 to be bent is subjected to longitudinal thrust exerted by a shoe 2. At its other end, an arm 3 pivoting about an axis 4 and surrounding the tube by means of a jaw 5 serves to bend the tube which is locally raised to a high temperature by an inductive collar 6. A necked roller or diabolo 7 provides external guidance to the tube upstream from and in the proximity of the zone heated by the heating collar.

Inside the tube, a carriage 8 is held stationary by a rod 9 fixed at a point 10. The carriage is provided with guide wheels 11, 12, and 13. On the opposite side to the rods, a support ring 14 is connected to the carriage and is provided around its periphery with a layer 15 of heat insulation such as rock wool. The distance D between the fixing point 10 of the rod 9 and the plane of symmetry through the heated zone (or through the heat insulation) must be kept constant.

The support ring 14 is constituted, for example, by four 90° sectors which are connected to one another by means of overlapping sheets. Cheek plates 17 and 18 are fixed to each other by spacers 19, and plates 20 and 21 are fixed thereto for supporting wheels 11 and 12. An angle bracket 22 supports a rod 23 which in turn supports a plate 24 carrying a wheel 13. The plate 24 is urged outwardly towards the inside wall of the tube by a helical spring 25.

The zone which is heated to a temperature such that the plasticity stress is exceeded, is located a little way downstream from the heating collar in the direction of tube advance, so the thermal insulation 15 reduces the temperature gradient across the tube thickness, and thus ensures an average plasticity stress coefficient in the tube greater than that which would be obtained in the absence of the thermal insulation. It thus makes it possible to increase the speed of tube advance and the hourly rate of bent tube production, and at the same time makes it possible to increase the maximum diameter and thickness of tubes which can be bent on the machine.

We claim:

1. In a method of bending a thick metal tube of constant cross-section about a center of curvature by localized heating of a narrow zone of the periphery of said tube by means of a heating collar surrounding said zone, by thrusting against one end of the tube and by holding its other end by means of a pivoting arm, wherein the temperature of the heated zone around the periphery of the tube is maintained substantially constant by detecting, at at least two points around said periphery, either the temperature of said heated zone or else the size of the gap between the heating collar and the periphery of said zone, a first one of said points being nearest to the center of curvature and the other point being opposite to the first point and furthest from said center of curvature, and by increasing or reducing the application of heat at one or other of these points depending on whether the temperature thereat is below or above, or on whether the gap thereat is above or below a reference value corresponding to a uniform temperature or to a uniform gap around the heated zone; the improvement comprising the step of disposing a layer of thermal insulation within the pipe and inside the heated zone, said layer of thermal insulation having a thickness sufficient to considerably reduce the temperature gradient between inside and outside surfaces of the tube in the heated zone.

2. Apparatus for bending a thick metal tube of constant cross-section about a center of curvature by localized heating of a narrow zone of the periphery of said tube, said apparatus comprising:

(a) a heating collar surrounding said zone;

(b) a member for thrusting against one end of the tube;

(c) a pivoting arm causing the other end of said tube to follow a curvilinear path;

(d) means for detecting, at at least two points round said periphery, either the temperature of said heated zone or else the size of the gap between the heating collar and the periphery of said zone, a first one of said points being nearest to the center of curvature and the other point being opposite to the first point and furthest from said center of curvature;

(e) means for increasing or reducing the application of heat at one or other of said points depending on whether the temperature thereat is below or above a reference value corresponding to uniform temperature around the heated zone, or on whether the gap thereat is above or below a reference value corresponding to a uniform gap around the heated zone;

(f) a cylindrical carriage having wheels for internal guidance inside the tube;

(g) a metal support ring fixed to the carriage inside the tube and slightly downstream from the heating collar in the direction of tube advance, said ring being covered with a thermally insulating layer having an outside diameter slightly less than the inside diameter of the tube and substantially equal to the outside diameter of the the carriage, said thermally insulating layer having a thickness sufficient to considerably reduce the temperature gradient between inside and outside surfaces of the tube in the heated zone; and (h) a rod holding the carriage in a fixed longitudinal position such that the thermally insulating layer is located in alignment with the heated zone.

* * * * *